US011815924B2

(12) United States Patent
Li et al.

(10) Patent No.: US 11,815,924 B2
(45) Date of Patent: Nov. 14, 2023

(54) BANDGAP REFERENCE STARTING CIRCUIT WITH ULTRA-LOW POWER CONSUMPTION

(71) Applicant: IPGoal Microelectronics (Sichuan) Co., Ltd., Sichuan (CN)

(72) Inventors: Xiaoyu Li, Sichuan (CN); Xiangyang Guo, Sichuan (CN)

(73) Assignee: IPGOAL MICROELECTRONICS (SICHUAN) CO., LTD., Sichuan (CN)

( * ) Notice: Subject to any disclaimer, the term of this patent is extended or adjusted under 35 U.S.C. 154(b) by 0 days.

(21) Appl. No.: 18/069,727

(22) Filed: Dec. 21, 2022

(65) Prior Publication Data

US 2023/0127794 A1 Apr. 27, 2023

(30) Foreign Application Priority Data

Nov. 28, 2022 (CN) ..... 202211500912.6

(51) Int. Cl.
*G05F 3/26* (2006.01)
*G05F 1/565* (2006.01)

(52) U.S. Cl.
CPC ..... *G05F 1/565* (2013.01); *G05F 3/262* (2013.01)

(58) Field of Classification Search
None
See application file for complete search history.

(56) References Cited

U.S. PATENT DOCUMENTS 4,539,551 A * 9/1985 Fujita ..... H03K 5/249 341/158
6,292,050 B1 * 9/2001 Dooley ..... G05F 3/245 327/540
6,351,111 B1 * 2/2002 Laraia ..... G05F 3/267 323/907
6,356,064 B1 * 3/2002 Tonda ..... H03K 17/223 327/539
6,784,652 B1 * 8/2004 Aude ..... G05F 3/30 323/315
6,998,902 B2 * 2/2006 Sugimura ..... G05F 3/30 327/539
7,550,958 B2 * 6/2009 Lee ..... G05F 3/30 327/539
8,350,611 B1 * 1/2013 Hsu ..... G05F 3/30 327/539

(Continued)

FOREIGN PATENT DOCUMENTS

CN 110825156 A 2/2020
CN 111142602 A 5/2020

*Primary Examiner* — Thomas J. Hiltunen
(74) *Attorney, Agent, or Firm* — SHIMOKAJI IP

(57) ABSTRACT

A bandgap reference starting circuit with ultra-low power consumption includes a current generating unit and a first bias voltage generating unit respectively connected with a power supply voltage. The current generating unit generates an nA-level current and a starting voltage for the first bias voltage generating unit. The first bias voltage generating unit is started and generates a first bias voltage according to the starting voltage, and output the first bias voltage to a bandgap reference circuit to start up the bandgap reference circuit. The starting circuit can normally start up a bandgap reference circuit of nA level, and has an nA-level working current, thereby reducing power consumption and saving the cost.

5 Claims, 1 Drawing Sheet

(56) References Cited

U.S. PATENT DOCUMENTS

| | | | | |
|---|---|---|---|---|
| 8,941,437 | B2 * | 1/2015 | Nakamoto | G05F 3/205 327/539 |
| 9,195,924 | B2 * | 11/2015 | Wu | G06K 19/0723 |
| 10,061,340 | B1 * | 8/2018 | Rao | G05F 3/267 |
| 2015/0137781 | A1 * | 5/2015 | Qu | G05F 1/56 323/280 |

* cited by examiner

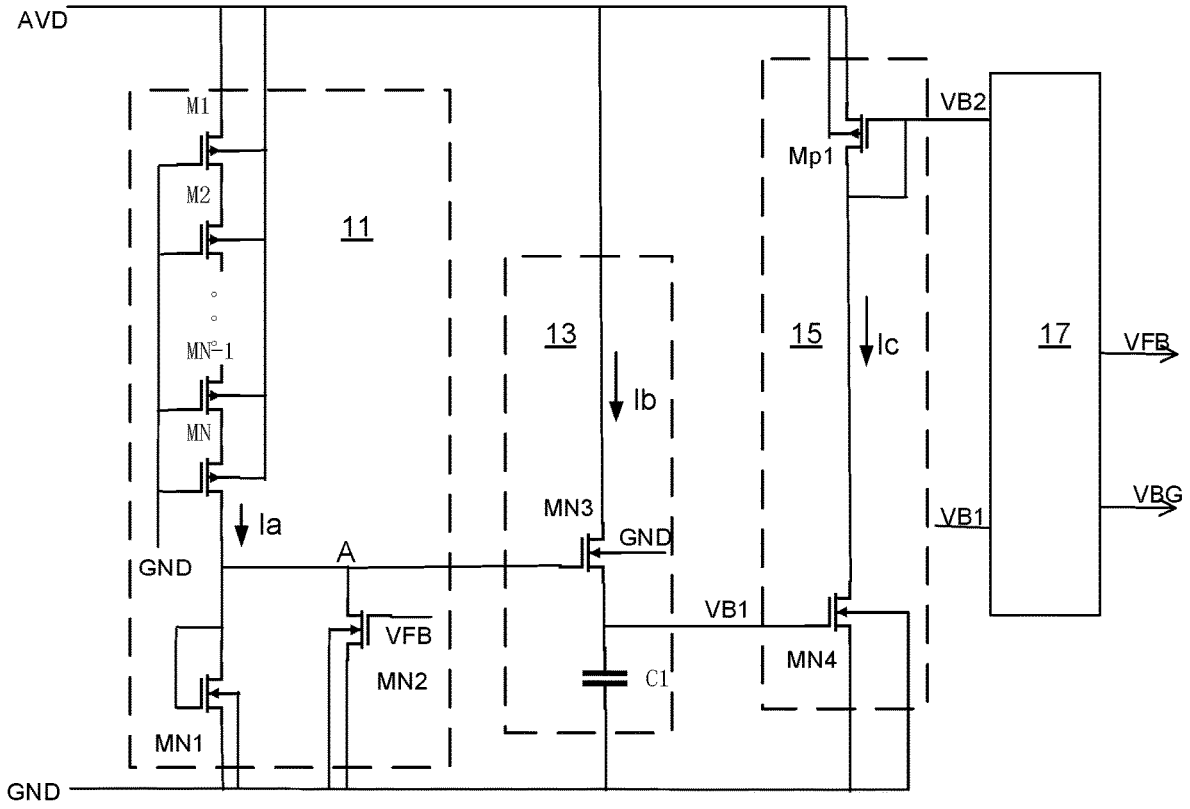
AVD
M1
M2
MN²-1
MN
11
13
15
17
Ia
Ib
Ic
GND
A
MN3
GND
VB2
Mp1
VB1
VFB
VBG
VFB
MN2
C1
MN4
MN1
GND

BANDGAP REFERENCE STARTING CIRCUIT WITH ULTRA-LOW POWER CONSUMPTION

FIELD OF THE INVENTION

The application relates to the field of integrated circuits, in particular to a bandgap reference starting circuit with ultra-low power consumption.

BACKGROUND OF THE INVENTION

With the popularization and iteration of portable electronic products in the market, requirements of the power consumption and performance for chips become higher and higher. A bandgap reference circuit is the basic component of the integrated circuit, which is necessary for different product requirements.

In order to achieve ultra-low power consumption, a bandgap reference circuit of ultra-low power consumption needs to use high impedance to reduce the working current, compared with the traditional bandgap reference circuit. Generally, resistor series may be added directly in the bandgap reference circuit to reduce the working current. However, such a manner of adding resistor series is not suitable for the bandgap reference circuit with nA-level working current, which leads to unstable driving and unstable working state, and affects the work of the bandgap reference circuit and further affects the working performance of the whole chip.

Therefore, it is necessary to provide an improved bandgap reference starting circuit of ultra-low power consumption to effectively start up a bandgap reference circuit to overcome the above defects.

SUMMARY OF THE INVENTION

The purpose of the present application is to provide a bandgap reference starting circuit with ultra-low power consumption, which can normally start up an nA-level bandgap reference circuit, and has an nA-level working current, thereby reducing power consumption and saving the cost.

To achieve the above purpose, a bandgap reference starting circuit with ultra-low power consumption includes a current generating unit and a first bias voltage generating unit respectively connected with a power supply voltage. The current generating unit is configured to generate an nA-level current and a starting voltage for the first bias voltage generating unit. The first bias voltage generating unit is configured to start and generate a first bias voltage according to the starting voltage provided by the current generating unit, and output the first bias voltage to a bandgap reference circuit to start up the bandgap reference circuit. The first bias voltage generation unit includes a third MOS transistor and a capacitor; a drain of the third MOS transistor is connected with the power supply voltage, a gate of the third MOS transistor is connected with the current generation unit, and a source of the third MOS transistor is connected with an input terminal of the bandgap reference circuit; one end of the capacitor is connected with the source of the third MOS transistor, and the other end of the capacitor is grounded.

As a preferable embodiment, the circuit further includes a second bias voltage generation unit connected with the power supply voltage, the first bias voltage generation unit and the input terminal of the bandgap reference circuit, respectively; wherein the source of the third MOS transistor is connected with the second bias voltage generation unit to input the first bias voltage to the second bias voltage generating unit, and the second bias voltage generating unit is started using the first bias voltage as a starting voltage to generate a second bias voltage which is output to the bandgap reference circuit.

As a preferable embodiment, the current generating unit comprises a first MOS transistor, a second MOS transistor and n inverted ratio MOS transistors connected in series; a drain of a first inverted ratio MOS transistor is connected with the power supply voltage, a source of an nth inverted ratio MOS transistor is jointly connected with a drain of a second MOS transistor, the drain and a gate of the first MOS transistor, and further connected with the first bias voltage generating unit; a gate of the second MOS transistor is connected with the output terminal of the bandgap reference circuit; the sources of the first MOS transistor and the second MOS transistor are grounded, and n is a natural number greater than 1.

As a preferable embodiment, the second bias voltage generating unit comprises a fourth MOS transistor and a fifth MOS transistor; a gate of the fourth MOS transistor is connected with a source of the third MOS transistor, a source of the fourth MOS transistor is grounded, the drain of the third MOS transistor is connected with a drain of the fifth MOS transistor, a source of the fifth MOS transistor is connected with the power supply voltage, a gate of the fifth MOS transistor is connected with a drain of the fifth MOS transistor and is connected with the other input terminal of the bandgap reference circuit.

As a preferable embodiment, each of the inverted ratio MOS transistors is an N-type MOS transistor and has a length-width ratio of greater than 1.

As a preferable embodiment, the first MOS transistor, the second MOS transistor, the third MOS transistor and the fourth MOS transistor are N-type MOS transistors, and the fifth MOS transistor is P-type MOS transistor.

As a preferable embodiment, a current mirror structure is formed by the fifth MOS transistor and the bandgap reference circuit.

In comparison with the prior arts, in the bandgap reference starting circuit with ultra-low power consumption according to the present application, by means of the nA-level current generated by the current generating unit, the first bias voltage generating unit and the second bias voltage generating unit are started up sequentially to generate the first bias voltage and the second bias voltage successively. The bandgap reference circuit will not be started up until the second bias voltage is generated. In the process of starting, both the first bias voltage and the second bias voltage are generated only when their voltage values reaches a preset starting value, so that the two bias voltages generated are stable and reliable, thereby starting up the bandgap reference circuit stably and reliably. Furthermore, during the operation of the whole starting circuit, the working currents of the current generating unit, the first bias voltage generating unit and the second bias voltage generating unit are all at nA level, which also ensures that the whole starting circuit has been maintained at the level of ultra-low power consumption.

The application will become clearer by the following description in conjunction with drawings which are used to explain embodiments of the application.

BRIEF DESCRIPTION OF THE DRAWINGS

The accompanying drawings facilitate an understanding of the various embodiments of this application. In such drawings:

FIG. 1 is a schematic diagram of a bandgap reference starting circuit with ultra-low power consumption according to an embodiment of the present application.

DETAILED DESCRIPTION OF ILLUSTRATED EMBODIMENTS

In order to make the purpose, technical solutions and advantages of the present application more clearly understood, the present application will be described in further detail below with reference to the accompanying drawings and embodiments. It should be understood that the specific embodiments described herein are only used to explain the present application, but not to limit the present application. The same reference numbers in different figures represent the same parts. The present application is aimed at providing a bandgap reference starting circuit with ultra-low power consumption, which can normally start up a bandgap reference circuit of nA level, and has an nA-level working current, thereby reducing power consumption and saving the cost.

Referring to FIG. 1, a schematic diagram of a bandgap reference starting circuit with ultra-low power consumption. As illustrated, the bandgap reference starting circuit with ultra-low power consumption includes a current generating unit 11, a first bias voltage generating unit 13 and a second bias voltage generating unit 15 respectively connected with a power supply voltage AVD. The current generating unit 11 is configured to generate an nA-level current and a starting voltage for the first bias voltage generating unit 13, in such a way, the power consumption of the current generating unit 11 and the first bias voltage generating unit 13 can be kept at a relatively low level to ensure the ultra-low power consumption for the whole starting circuit. The first bias voltage generating unit 13 is started according to the starting voltage provided by the current generating unit 11 to generate a first bias voltage, and output the first bias voltage to the second bias voltage generating unit 15. The second bias voltage generating unit 15 is started by using the first bias voltage as a starting voltage to generate a second bias voltage. The first bias voltage and the second bias voltage are both output to a bandgap reference circuit 17 to start up the bandgap reference circuit 17.

In such a way, by means of the current generating unit 11, the first bias voltage generating unit 13 and the second bias voltage generating unit 15 are started up sequentially to generate the first bias voltage and the second bias voltage successively. The bandgap reference circuit 17 will not be started up until the second bias voltage is generated. In the process of starting, the first bias voltage and the second bias voltage are generated only when their voltage values reaches a preset starting value, so that the two bias voltages generated are stable and reliable, thereby starting up the bandgap reference circuit 17 stably and reliably. In addition, in some situations, only one bias voltage is needed to start up the bandgap reference circuit 17. In such a situation, the second bias voltage generating unit 15 is not required, and only the first bias voltage generated by the first bias generating unit can normally start up the bandgap reference circuit 17. Therefore, the second bias voltage generating unit 15 is optional, which depends on the actual requirements of the bandgap reference circuit that needs to be started up.

Specifically, as shown in FIG. 1, the current generating unit 11 includes a first MOS transistor MN1, a second MOS transistor MN2 and n inverted ratio MOS transistors (M1, M2 . . . Mn-1, Mn) connected in series. A drain of the first inverted ratio MOS transistor M1 is connected with the power supply voltage AVD, the source of the nth inverted ratio MOS transistor Mn is jointly connected with the drain of the second MOS transistor MN2, the drain and the gate of the first MOS transistor MN1, and further connected with the first bias voltage generating unit 13, so as to provide a starting voltage to the first bias voltage generating unit 13. The gate of the second MOS transistor MN2 is connected with an output terminal of the bandgap reference circuit 17, so as to further control the turning-on or turning-off of the second MOS transistor MN2 through the output voltage VFB of the bandgap reference circuit 17, thereby enhancing the feedback control. The sources of the first MOS transistor and the second MOS transistor are grounded. As a preferable embodiment, each of the inverted ratio MOS transistors (M1, M2 . . . Mn-1, Mn) is an N-type MOS transistor and has a length-width ratio of greater than 1, so as to ensure that the current Ia generated by the current generating unit 11 is small and at nA current. In the present invention, n is a natural number greater than 1, and the value of n may be determined according to the actual use requirements of the circuit. When the value of n is larger, the current generated by the current generating unit 11 will be smaller; otherwise, the current generated by the current generating unit 11 will be larger. Therefore, as long as the current Ia generated by the current generating unit 11 is at nA level, the specific current value can be flexibly selected according to the actual situation, to choose an appropriate value of n.

Specifically, the first bias voltage generation unit includes a third MOS transistor MN3 and a capacitor C1. The drain of the third MOS transistor MN3 is connected with the power supply voltage AVD, the gate of the third MOS transistor MN3 is connected with the current generation unit, and the source of the third MOS transistor MN3 is connected with an input terminal of the bandgap reference circuit 17, so as to input the first bias voltage VB1 to the bandgap reference circuit 17. One end of the capacitor C1 is connected with the source of the third MOS transistor MN3, and the other end of the capacitor C1 is grounded. In this unit, the current generating unit 11 is connected with the gate of the third MOS transistor MN3, so that the third MOS transistor MN3 can be turned on through the voltage on the current generating unit 11, to charge the capacitor C1. During charging process, the source voltage of the third MOS transistor MN3 (that is, the first bias voltage VB1) can be slowly increased. That is to say, as the third MOS transistor MN3 is turned on, the voltage value of the first bias voltage VB1 slowly reaches the voltage value required by the bandgap reference circuit 17.

Specifically, the second bias voltage generating unit 15 includes a fourth MOS transistor MN4 and a fifth MOS transistor MP1. The gate of the fourth MOS transistor MN4 is connected with the source of the third MOS transistor MN3, the source of the fourth MOS transistor MN4 is grounded, the drain of the third MOS transistor MN3 is connected with the drain of the fifth MOS transistor MP1, the source of the fifth MOS transistor MN4 is connected with the power supply voltage AVD, and the gate of the fifth MOS transistor MP1 is connected with the drain of the fifth MOS transistor MP1 and is connected with the other input terminal of the bandgap reference circuit 17. In this unit, when the source voltage of the third MOS transistor MN3 reaches the voltage value of the first bias voltage VB1, the second bias voltage generating unit 15 will be started up and the fourth MOS transistor MN4 will be turned on, so that the fifth MOS transistor MP1 will generate a second bias voltage VB2 and input it to the bandgap reference circuit 17 to start up the bandgap reference circuit 17. As a preferable embodiment of the invention, the first MOS transistor MN1, the second MOS transistor MN2, the third MOS transistor MN3 and the fourth MOS transistor MN4 are all N-type MOS transistors, and the fifth MOS transistor MP1 is P-type MOS transistor to ensure a stable current and a stable voltage to be generated. In addition, a current mirror structure is formed by the fifth MOS transistor and the bandgap reference circuit 17, and the working current of the bandgap reference circuit 17 is at nA level, thus the current Ic on the second bias voltage generating unit 15 where the fifth MOS transistor MP1 is located is also at nA level, thereby achieving the ultra-low power consumption for the second bias voltage generating unit 15.

Referring to FIG. 1 again, the working principle of the bandgap reference starting circuit with ultra-low power consumption according to the invention follows.

In the initial state, the current generating unit 11 in the circuit is turned on by default, and the inverted ratio MOS transistors M1 to Mn in series are configured to provide enough resistance value to control the current Ia of the current generating unit 11 at nA level. For the first bias voltage generating unit 13, as the bandgap reference circuit 17 does not start to work, with an output voltage VFB=0, which means that the second MOS transistor MN2 is in a turn-off state. At this time, the gate voltage of the first MOS transistor MN1 is taken as the gate bias voltage of the third MOS transistor MN3 to turn on the third MOS transistor MN3 to charge the capacitor C1. Specifically, the length-width ratio of the third MOS transistor MN3 and the capacitance value of the capacitor C1 may be adjusted to control the charging time of capacitor C1 and the charging current Ib. In the second bias voltage generation unit, the initial value of the first bias voltage VB1 is 0 (capacitor C1 is not charged), and the fourth MOS transistor MN4 is not turned on, thus the first bias voltage VB1 gradually rises as the third MOS transistor MN3 is turned on to charge the capacitor C1. The first bias voltage VB1 is increased to reach the turn-on voltage of the fourth MOS transistor MN4 to turn on the fourth MOS transistor MN4, in such a way, the second bias voltage generation unit is started up to generate a second bias voltage VB2 through the gate of the fifth MOS transistor MP1. The first offset voltage VB1 and the second offset voltage VB2 are both input into the bandgap reference circuit 17 to start up the bandgap reference circuit 17. When the bandgap reference circuit 17 is in working state, its output voltage VFB will rise to turn on the second MOS transistor MN2. The second MOS transistor MN2 is connected in parallel with the first MOS transistor MN1. The current Ia flows to the second MOS transistor MN2, and the n inverted ratio transistors M1 to Mn are connected to the second MOS transistor MN2 in series for voltage division. As the impedance of the second MOS transistor MN2 is far less than the total impedance of the n inverted ratio transistors M1 to Mn in series, thus the node A is equivalent to grounding, so that the gate voltage of the third MOS transistor MN3 is pulled down to the ground, the third MOS transistor MN3 is turned off, and the first bias voltage generating unit 13 is closed and no longer charges the capacitor C1. Accordingly, the first bias voltage VB1 no longer rises, the second bias voltage generation unit also stabilized, the second bias voltage VB2 no longer changes, and the bandgap reference circuit 17 continues to work normally.

To sum up, in the bandgap reference starting circuit with ultra-low power consumption according to the present application, by means of the nA-level current generated by the current generating unit, the first bias voltage generating unit and the second bias voltage generating unit are started sequentially to generate the first bias voltage and the second bias voltage successively. The bandgap reference circuit will not be started up until the second bias voltage is generated. In the process of starting, both the first bias voltage and the second bias voltage are generated only when their voltage values reaches a preset starting value, so that the two bias voltages generated are stable and reliable, thereby starting up the bandgap reference circuit stably and reliably. Furthermore, during the operation of the whole starting circuit, the working currents of the current generating unit, the first bias voltage generating unit and the second bias voltage generating unit are all at nA level, which also ensures that the whole starting circuit has been maintained at the level of ultra-low power consumption.

The above-mentioned embodiments only represent several embodiments of the present application, and the descriptions thereof are relatively specific and detailed, but should not be construed as limiting the scope of the patent application. It should be pointed out that for those skilled in the art, several modifications and improvements can be made without departing from the concept of the present application, which all belong to the protection scope of the present application. Therefore, the scope of protection of the patent of the present application shall be subject to the appended claims.

What is claimed is:

1. A bandgap reference starting circuit with ultra-low power consumption, comprising a current generating unit and a first bias voltage generating unit respectively connected with a power supply voltage;

wherein the current generating unit is configured to generate an nA-level current and a starting voltage for the first bias voltage generating unit;

the first bias voltage generating unit is configured to start and generate a first bias voltage according to the starting voltage provided by the current generating unit, and output the first bias voltage to a bandgap reference circuit to start up the bandgap reference circuit;

wherein the first bias voltage generation unit comprises a third MOS transistor and a capacitor; a drain of the third MOS transistor is connected with the power supply voltage, a gate of the third MOS transistor is connected with the current generation unit, and a source of the third MOS transistor is connected with an input terminal of the bandgap reference circuit; one end of the capacitor is connected with the source of the third MOS transistor, and the other end of the capacitor is grounded;

wherein a second bias voltage generation unit is further included and connected with the power supply voltage, the first bias voltage generation unit and the input terminal of the bandgap reference circuit, respectively; the source of the third MOS transistor is connected with the second bias voltage generation unit to input the first bias voltage to the second bias voltage generating unit, and the second bias voltage generating unit is started using the first bias voltage as a starting voltage to generate a second bias voltage which is output to the bandgap reference circuit;

wherein the current generating unit comprises a first MOS transistor, a second MOS transistor and n inverted ratio MOS transistors connected in series: a drain of a first inverted ratio MOS transistor is connected with the power supply voltage, a source of an nth inverted ratio MOS transistor is jointly connected with a drain of a second MOS transistor, the drain and a gate of the first MOS transistor, and further connected with the first bias voltage generating unit; a gate of the second MOS transistor is connected with the output terminal of the bandgap reference circuit; the sources of the first MOS transistor and the second MOS transistor are grounded, and n is a natural number greater than 1.

2. The circuit according to claim 1, wherein the second bias voltage generating unit comprises a fourth MOS transistor and a fifth MOS transistor; a gate of the fourth MOS transistor is connected with a source of the third MOS transistor, a source of the fourth MOS transistor is grounded, the drain of the third MOS transistor is connected with a drain of the fifth MOS transistor, a source of the fifth MOS transistor is connected with the power supply voltage, a gate of the fifth MOS transistor is connected with a drain of the fifth MOS transistor and is connected with the other input terminal of the bandgap reference circuit.

3. The circuit according to claim 1, wherein each of the inverted ratio MOS transistors is an N-type MOS transistor and has a length-width ratio of greater than 1.

4. The circuit according to claim 2, wherein the first MOS transistor, the second MOS transistor, the third MOS transistor and the fourth MOS transistor are N-type MOS transistors, and the fifth MOS transistor is P-type MOS transistor.

5. The circuit according to claim 2, wherein a current mirror structure is formed by the fifth MOS transistor and the bandgap reference circuit.

* * * * *